US008176821B2

(12) United States Patent
Taillardat

(10) Patent No.: US 8,176,821 B2
(45) Date of Patent: May 15, 2012

(54) MACHINE FOR PROCESSING SHEETS WITH CUTOUTS OF FOLDS TRANSVERSE TO THEIR FORWARD MOVING DIRECTION

(75) Inventor: Jean-Jacques Taillardat, Murs-Erigne (FR)

(73) Assignee: Rapidex S.M. (FR)

( * ) Notice: Subject to any disclaimer, the term of this patent is extended or adjusted under 35 U.S.C. 154(b) by 805 days.

(21) Appl. No.: 10/517,037

(22) PCT Filed: Jun. 6, 2003

(86) PCT No.: PCT/FR03/01700

§ 371 (c)(1),
(2), (4) Date: Jan. 31, 2005

(87) PCT Pub. No.: WO03/103937

PCT Pub. Date: Dec. 18, 2003

(65) Prior Publication Data

US 2005/0145083 A1 Jul. 7, 2005

(30) Foreign Application Priority Data

Jun. 7, 2002 (FR) ..... 02 07032

(51) Int. Cl.
*B23D 25/02* (2006.01)

(52) U.S. Cl. ..... 83/331; 83/346; 83/365

(58) Field of Classification Search ..... 83/295, 83/286, 311, 365, 371, 298, 367, 368, 370, 83/331, 346–348

See application file for complete search history.

(56) References Cited

U.S. PATENT DOCUMENTS

| | | | | |
|---|---|---|---|---|
| 3,143,020 | A * | 8/1964 | Ehinger | 83/286 |
| 3,555,948 | A * | 1/1971 | Olson | 83/117 |
| 3,899,945 | A * | 8/1975 | Garrett et al. | 83/38 |
| 4,183,271 | A * | 1/1980 | Martin | 83/156 |
| 4,640,165 | A * | 2/1987 | McMahon et al. | 83/346 |
| 4,724,732 | A * | 2/1988 | Miyauchi et al. | 83/37 |
| 4,934,231 | A * | 6/1990 | Chesnut et al. | 83/343 |
| 4,962,683 | A * | 10/1990 | Scheffer et al. | 83/103 |
| 5,297,461 | A * | 3/1994 | Hirakawa et al. | 83/304 |
| 5,761,982 | A * | 6/1998 | Abt et al. | 83/861 |

(Continued)

FOREIGN PATENT DOCUMENTS

EP 0 108 356 5/1984

(Continued)

*Primary Examiner* — Boyer D Ashley
*Assistant Examiner* — Omar Flores Sanchez
(74) *Attorney, Agent, or Firm* — Ostrolenk Faber LLP

(57) ABSTRACT

The invention concerns a machine comprising driving means (14, 16, 18) for driving sheets in a drive direction (F) through a processing zone (T), and processing means including a tool (53, 53') and a counter tool (56), respectively, borne by a first and by a second transverse rotary support shaft (52, 54). Said processing means are designed to produce in the sheets cutouts and folds transverse to their drive direction. The counter tool has a substantially cylindrical surface having at least one working strip (57) which extends parallel to the axis of the second support shaft and is radially offset relative to the portions (58) of said surface which are adjacent to said strip, the latter being designed to cooperate with the tool to form a cutout or a fold in a sheet.

16 Claims, 7 Drawing Sheets

U.S. PATENT DOCUMENTS

| | | | | |
|---|---|---|---|---|
| 5,797,305 | A * | 8/1998 | Harrod et al. | 83/37 |
| 5,887,502 | A * | 3/1999 | Yamaguchi et al. | 83/76 |
| 5,893,314 | A * | 4/1999 | Kapolnek et al. | 83/698.41 |
| 6,205,898 | B1 * | 3/2001 | Surina | 83/76 |
| 6,220,134 | B1 * | 4/2001 | Thiel et al. | 83/74 |
| 6,311,601 | B1 | 11/2001 | Love | |
| 6,360,640 | B1 * | 3/2002 | Cote | 83/287 |
| 6,401,583 | B1 | 6/2002 | Izawa et al. | |

FOREIGN PATENT DOCUMENTS

| | | |
|---|---|---|
| EP | 1 004 511 | 5/2000 |
| EP | 1 072 369 | 1/2001 |
| JP | 2000 061888 | 2/2000 |
| WO | WO 02 02305 | 1/2002 |

* cited by examiner

E
T
S
U1
U2
M52
M62
M54
M54'
S52
S62
V52
V54
V62
V54'
V
M
F
P
10
12
14
16
18
30
32
34
36
38
40
42
44
46
48
52
53
53'
54
54'
56
56'
57
58
62
63

MACHINE FOR PROCESSING SHEETS WITH CUTOUTS OF FOLDS TRANSVERSE TO THEIR FORWARD MOVING DIRECTION

BACKGROUND OF THE INVENTION

The present invention concerns a machine for processing sheets for the production of packagings in materials such as cardboard or plastic, comprising driving means capable of driving sheets in a drive direction at a substantially constant drive speed through a processing zone situated between the entrance and the exit of the machine and processing means comprising a tooling and a counter-tooling respectively borne by a first and by a second rotary support shaft, which shafts extend transversely to the drive direction, being disposed opposite each other on either side of the path of the sheets, said processing means being designed to produce in these sheets cutouts and/or folds disposed transversely to the drive direction.

A machine of this type for processing sheets is known through patent application PCT WO 02/02305, filed by the applicant company. This previous patent application concerns the operation of the rotation of the support shaft of the tooling, which is performed so that, at the moment when the processing means cooperate with a sheet in order to make in it cutouts or folds transverse to the drive direction, the tangential speed of the tooling is equal to the drive speed of the sheet in the machine.

These measures allow the machine to be operated continuously, whereas it was previously necessary, in order to make cutouts or folds transverse to the drive direction of a sheet, to stop the latter momentarily and to actuate a cutting or creasing tool borne by a beam which can be moved perpendicularly to the drive direction of the sheets.

Although the machine described in document WO 02/02305 is satisfactory, it turns out that, in certain usage conditions, the cutting or the creasing made by the tooling borne by the first support shaft leaves traces of folds on the sheets processed in the machine. This is particularly the case where these sheets are made of corrugated board, the flutes of which are oriented transversely to the forward moving direction of the sheets, that is to say the cutting or the creasing are performed parallel to these flutes.

A corrugated board has at least two layers of paper or board, between which there is disposed at least one corrugated board, the corrugations of which form the aforesaid flutes. For example, these sheets can comprise a top or cover layer of paper, a first corrugated board, an intermediate layer of paper, a second corrugated board, and a top or inner layer of paper. In this case, if the cutting or the creasing is realized by first engaging the tooling with the top layer of paper, the folds can be formed on the bottom layer of paper.

SUMMARY OF THE INVENTION

These problems of folds can likewise occur in the processing of sheets made of other materials, in particular of sheets having a multilayered structure or with interposed corrugated boards, made at least partially of plastics material.

The object of the present invention is to eliminate these drawbacks or, at least, to limit the severity thereof.

This object is achieved by virtue of the fact that the counter-tooling has a substantially cylindrical surface having at least one working strip which extends parallel to the axis of the second support shaft and is radially offset relative to the portions of said surface which are adjacent to this strip, said working strip being designed to cooperate with the tooling to form a cutout or a fold in a sheet, and the fact that the first and second support shafts are each driven by a motor, the motor of the second support shaft being operated as a slave to the motor of the first shaft.

For the processing of a sheet, in particular in order to make cutouts or folds in certain regions thereof, the sheet is squeezed between the tooling and the counter-tooling. By convention, it is hereinafter borne in mind that, during the processing of the sheet, its top and bottom layers are respectively on the side of the tooling and on the side of the counter-tooling. The applicant company has found that, with traditional counter-toolings having a perfectly cylindrical surface, the sheet has a tendency to be crushed on the counter-tooling by the tooling. The penetration of the tooling into the thickness of the sheet initially deforms the top layer of paper, which is brought closer to the outer layer of paper owing to the local crushing of the corrugated board(s) present between these layers. The top layer is therefore stretched so as to move closer to the bottom sheet, whereas the latter is not stretched and remains held against the cylindrical surface of the counter-tooling.

The result is that the bottom layer cannot accompany the displacement of the top layer and folds are thus created on this layer, these folds being all the more troublesome since this layer is generally the outer layer which is visible when the packaging is brought into shape.

The applicant company has discovered that, by engaging the tooling with the working strip radially offset relative to the adjacent portions of the surface of the counter-tooling, it is possible to prevent the creation of these folds or, at least, to act to make these folds less pronounced.

Indeed, when the working strip projects radially relative to the adjacent portions of the surface of the counter-tooling, the bottom layer is not flush against this cylindrical surface in the immediate vicinity of the working strip. The result is that it can move slightly to accompany the aforesaid displacement of the top layer and that this movement takes place in the clearance formed on either side of the working strip, above the adjacent portions of the surface of the counter-tooling, so that the bottom layer is not compressed and no folds are created by this movement.

Another possibility consists in recessing the working strip relative to the adjacent portions of the surface of the counter-tooling. In this case, when the tooling cooperates with the sheet, its first action is to push the latter inside such a recess.

In other words, it is not only the top layer which moves and is stretched under the action of the tooling, but the latter likewise forces the bottom layer to move and stretch, albeit in slightly smaller proportions. The applicant company has found that this slight tension applied to the bottom layer prevents the creation of folds on the latter.

The surface of the counter-tooling is substantially cylindrical, the portions adjacent to the working strip defining portions of equal cylindrical surface area.

The first support shaft is operated in such a way that, at the moment when the tooling cooperates with the sheet, it is located in the correct region of this sheet and is propelled with a tangential speed equal to the speed of advance of the latter. Knowing, moreover, the position of the working strip(s) on the surface of the counter-tooling, the motor of the second support shaft is operated in such a way as to position a working strip correctly in the angular respect such that it cooperates with the tooling just as this is processing the sheet and such as, at this moment, to propel said working strip with a tangential speed equal to the speed of advance of the sheet. It is therefore as a function of the operation of the first support shaft that the operation of the second support shaft is determined.

Advantageously, the machine comprises means for operating the rotational drive of the support shafts, which means are capable of operating this drive so that, during the successive processing of a plurality of sheets, the tooling cooperates successively with different working strips.

By these measures, the premature wearing of the working strips can be prevented.

Advantageously, the surface of the counter-tooling has a plurality of working strips spaced angularly apart.

Advantageously, the surface of the counter-tooling thus has a regular alternation of projecting strips and withdrawn strips.

The multiplication of the number of working strips is beneficial from a practical viewpoint. Moreover, by choosing to place these working strips at regular intervals, the operation of the driving means for the support shaft of the counter-tooling is simplified.

In some cases, moreover, the choice can be made either to engage the tooling with projecting strips or to engage it with withdrawn strips, which two types of strips can constitute working strips within the meaning of the present invention.

Advantageously, the working strip is mounted detachably on the counter-tooling.

This detachable mounting allows a worn working strip to be easily changed for replacement by a new working strip.

Advantageously, the driving means are capable of driving the sheets at a substantially constant drive speed in the processing zone and the machine comprises means for operating the rotational drive of the support shafts, which means are capable of operating the rotational drive of said support shafts so that, at least at the moment when the tooling and the working strip cooperate with a sheet for the processing of the latter, the tooling is propelled with a processing speed, the tangential component of which is equal to said drive speed and the working strip is situated opposite this tooling.

Advantageously, the machine thus comprises means for determining information relating to the position of a sheet in the processing zone and it comprises a control unit capable, as a function of this information, of operating the rotational drive of the first and second support shafts so that, for the processing of this sheet, the tooling is in contact with a predefined region of the sheet and is propelled with a processing speed, the tangential component of which is equal to said drive speed, whereas the working strip is in contact with said defined region, but on the other side of the sheet relative to the tooling.

Advantageously, the means for operating the rotational drive of the support shafts are capable of operating this rotational drive so that, at least at the moment when the tooling and the working strip cooperate with a sheet for the processing of the latter, the tooling and the working strip are each propelled with a processing speed, the tangential component of which is equal to said drive speed.

According to one embodiment, the first support shaft is a multi-tooled support shaft capable of bearing at least a first and a second tool spaced angularly apart and the control unit is capable of operating the rotational drive of said multi-tooled support shaft according to a cycle comprising a processing phase performed by the first tool, in which said first tool is in contact with a defined first region of a sheet situated in the processing zone of the machine and is propelled with a tangential speed equal to the drive speed of this sheet, a positioning phase, in the course of which the multi-tooled support shaft is driven so as to place the second tool in a position to process a defined second region of the sheet, and a processing phase performed by the second tool, in which the second tool is in contact with said second region and is propelled with a tangential speed equal to the drive speed.

In this case, advantageously, the control unit is capable of operating the drive of the second support shaft so that, in the course of a cycle, the first and the second tool of the first support shaft cooperate with two separate working strips.

Advantageously, the first and second support shafts are each driven by a motor, the motor of the second support shaft being operated as a slave to the motor of the first shaft.

The invention will be clearly understood and its advantages will become more easily apparent from a reading of the following detailed description of an embodiment represented by way of non-limiting example.

BRIEF DESCRIPTION OF THE DRAWINGS

The description refers to the appended drawings, in which.

DESCRIPTION OF A PREFERRED EMBODIMENT

Figure 1:
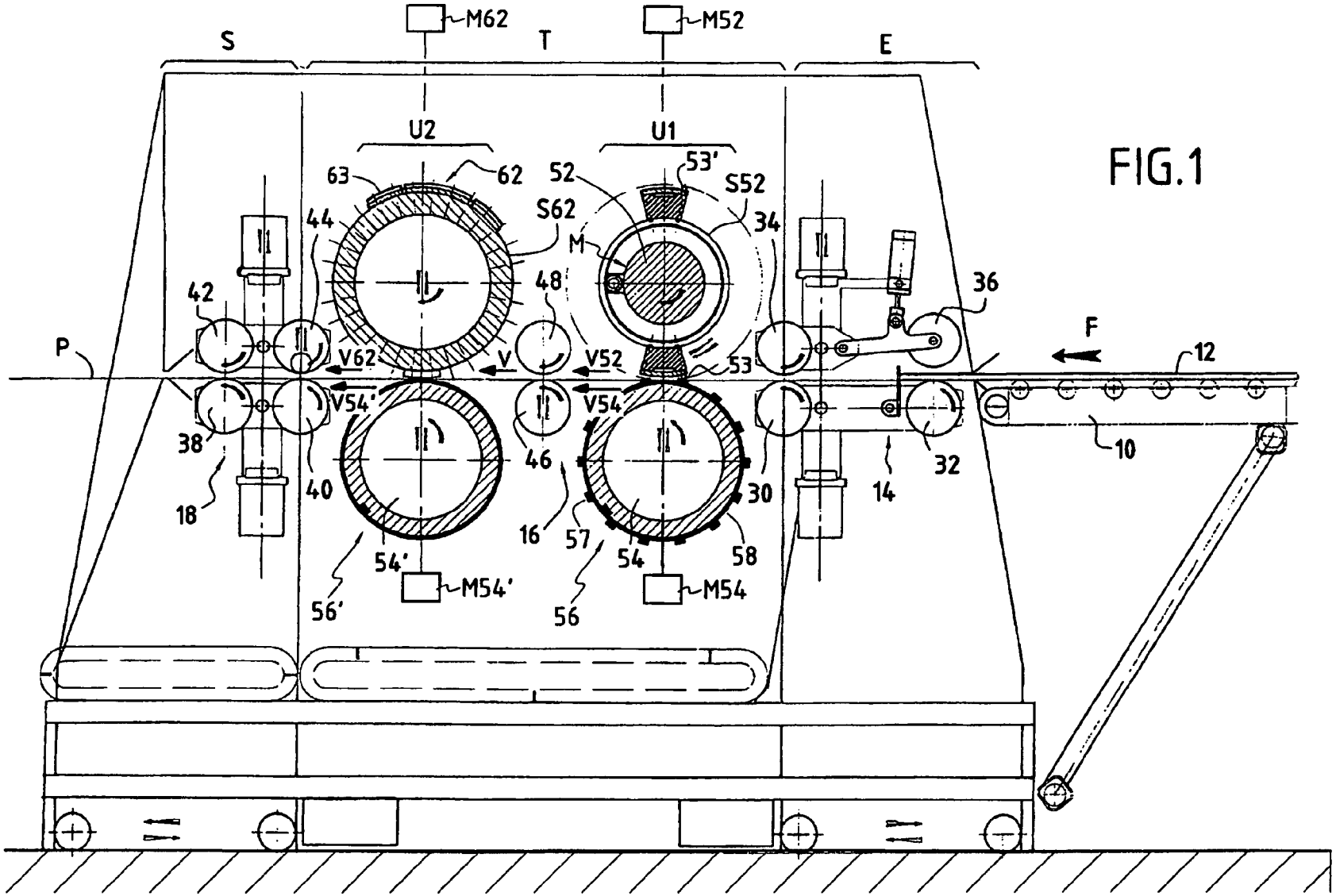
FIG. 1 is a sectional view of a machine according to the invention in a vertical plane.

The machine represented in FIG. 1 comprises a feed table 10 on which a sheet 12 is disposed for processing in the machine. The sheet in question, for example, has a corrugated multi-layered structure, made of cardboard or plastic.

The machine has an entrance zone E, a processing zone T and an exit zone S successively disposed in the forward moving direction F of the sheets. In the entrance zone E, the sheets are taken in hand by driving means 14, which drive them at constant speed through the processing zone T. In the represented example, this zone T comprises two processing units, respectively U1 and U2, disposed one after the other in the direction F. Located between these two units are drive relay means 16. Driving means 18 are likewise provided at the exit S of the machine.

Said machine serves to process sheets to configure them so that they can then be folded in such a way as to form a packaging.

Figure 2:
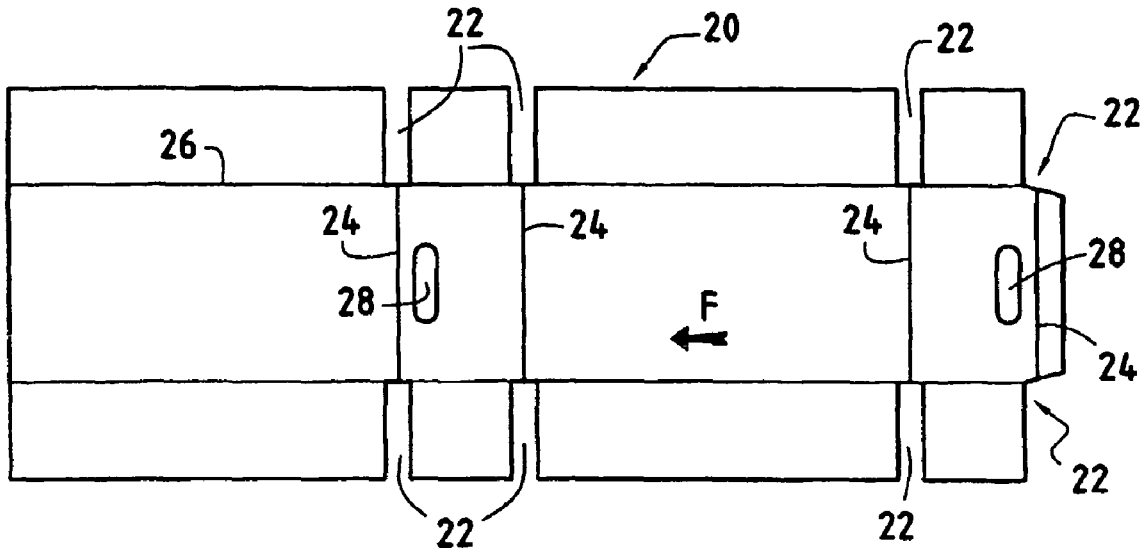
FIG. 2 shows the side flank of a packaging after it has been processed by the machine.

For example, FIG. 2 shows a side flank processed by the machine starting from a full sheet. This side flank has cutouts 22 and folds 24, disposed transversely to the forward moving direction F of the sheet in the machine. The toolings of the processing units U1 and U2 situated in the processing zone T of the machine allow these cutouts and folds to be produced. These toolings comprise cutting tools or knives which form cutouts 22 and creasing tools or creasers which form folds 24.

The side flank represented in FIG. 2 likewise comprises folds 26, which are disposed parallel to the direction F and which can be made by means of creaser rollers which cooperate with the driving means. The side flank also has specific cutouts, for example openings 28, which serve to form handles in the packaging and which are made in one of the units U1 and U2.

Figure 4:
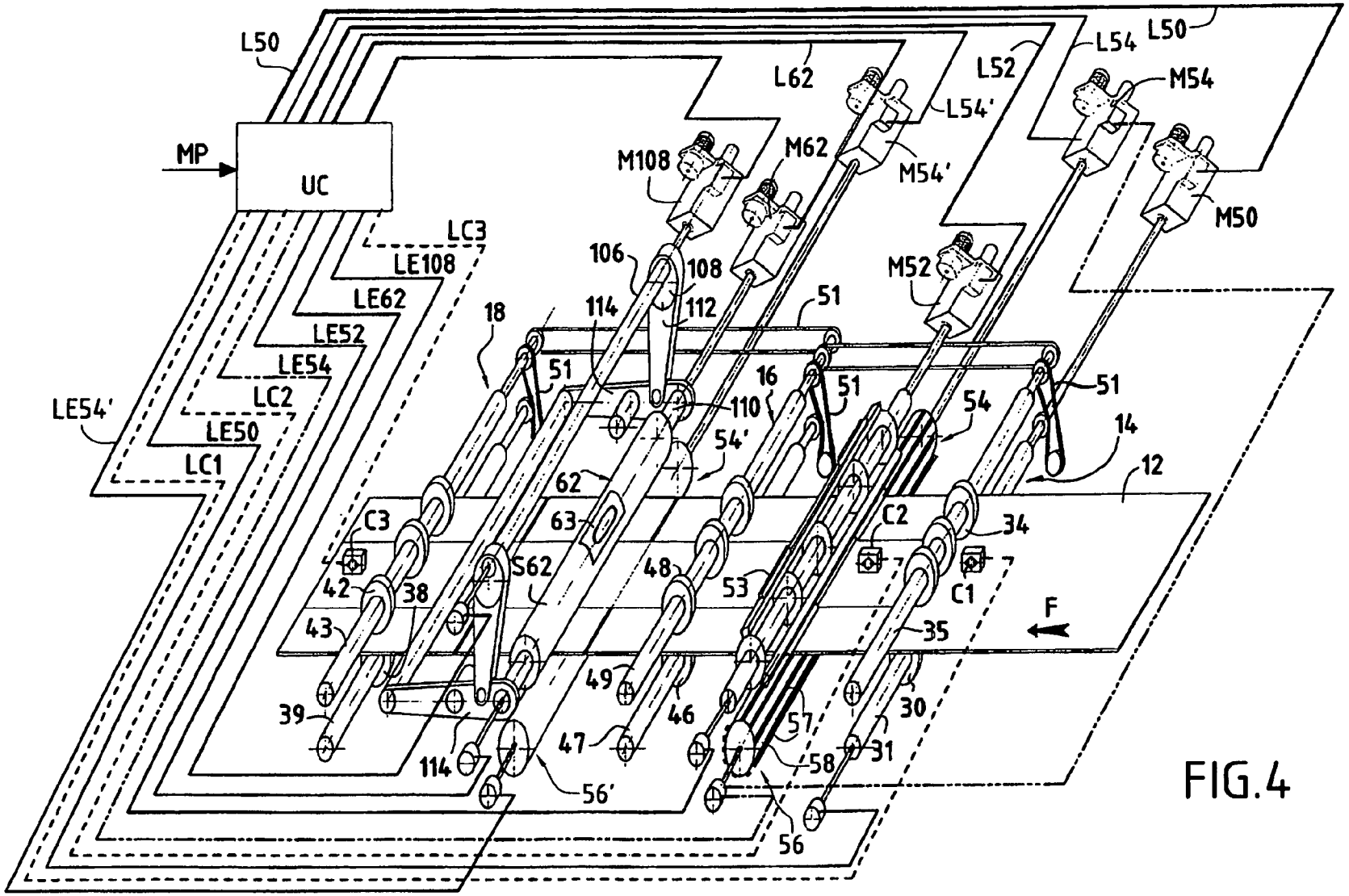
FIG. 4 is a synoptic view in perspective of the main elements of the machine, with the principle of their operation.

The driving means of the machine comprise drive rollers in the form of disks, which are rotationally driven. In FIG. 1, for example, at the entrance of the machine, lower drive rollers 30 and 32, and upper drive rollers 34 and 36, can be seen. Similarly, at the exit, the driving means 18 comprise lower rollers 38 and 40 and upper rollers 42 and 44. The drive relay means 16 likewise comprise lower 46 and upper rollers 48. In FIG. 1, the driving means 14 and 18 each comprise two rows of lower and upper rollers. In FIG. 4, for simplification purposes, only one row of rollers has been represented for each of these driving means.

FIG. 4 thus shows, at the entrance of the machine, the lower rollers 30 and the upper rollers 34 respectively mounted on a lower shaft 31 and on an upper shaft 35. Similarly, at the exit, the lower 38 and upper rollers 42 are respectively mounted on two shafts 39 and 43, whereas the intermediate rollers 46 and 48 of the relay 16 are mounted on two shafts 47 and 49. The driving means are driven by a main drive motor M50. The aforesaid different shafts are driven by this motor, to which they are connected by transmission means such as belts 51.

In general terms, the driving means can be analogous to those described in application PCT WO 02/02305.

Each of the processing units U1 and U2 comprises processing means which themselves comprise a tooling and a counter-tooling or counterpart for this tooling.

The unit U1 thus comprises a first support shaft 52, which bears tools 53 and 53', and a second support shaft 54, which bears a counter-tooling 56.

Similarly, the unit U2 comprises a first support shaft 62, which bears tools 63, and a second support shaft 54', which bears a counter-tooling 56'.

The counter-tooling 56 of the unit U1 has a substantially cylindrical surface having a plurality of working strips 57. These working strips extend parallel to the axis of the shaft 54, that is to say transversely to the direction F. The working strips 57 are radially offset relative to the portions 58 of the surface of the counter-tooling which are adjacent to these strips. In the case in question, the working strips 57 project over the surface of the counter-tooling.

The counter-tooling 56' of the unit U2 could be realized like the counter-tooling 56 of the unit U1, but in FIGS. 1 and 4 it has been chosen to give it a perfectly cylindrical surface by dint of the configuration of the tools 63, which are rotary cutting tools, the width of which, measured according to the circumference of the support shaft 62, is larger than that of the tools 53 and 53'.

These strips 57 are advantageously made of a material, such as polyurethane, sufficiently flexible to allow the tools to fulfill their function by cooperating with them.

In the unit U1, the tools 53 and 53' are cutting or creasing knives, which, during the cutting or creasing operations, can penetrate slightly into the polyurethane of the strips 57.

The shafts 52, 54, 62 and 54' are disposed transversely to the forward moving direction F of the sheets in the machine, so that the tools cooperate with their respective counter-tooling in the plane of advance P of the sheets in the machine, whereas the tools and the counter-toolings (or, for the counter-tooling 56, the strips 57) are propelled with tangential speeds, respectively V52, V62, V54 and V54', which are parallel to this plane and are directed in the forward moving direction F of the sheets. In the case in question, the first support shafts 52 and 62 are disposed above the plane P, whereas the second support shafts 54 and 54' are disposed below this plane.

Interest shall first be focused, more specifically, upon the processing unit U1.

The first support shaft 52 is rotationally driven by a motor M52, for example an asynchronous motor, a brushless motor or, in general terms, a positioning motor.

As indicated in WO 02/02305, the motor M52 is operated so that the tooling 53, 53' borne by the shaft 52 is propelled, at the moment when it enters into contact with the sheet 12 for the processing thereof, with a tangential speed V52 equal to the speed of advance V of this sheet.

For this, the machine comprises a control unit UC, which, as a function of information relating to the position of a sheet 12 in the processing zone T, operates the motor M52 via a control line L52. The information relating to the position of the sheet 12 is delivered, for example, as a sheet moves forward in the machine, by position sensors such as photoelectric cells C1, C2 and C3, which are successively disposed on the path of advance of the sheets and which are connected to the control unit UC by information input lines, respectively LC1, LC2 and LC3.

The working of the means by which the position of the sheet can be known is described in greater detail in WO 02/02305.

The control unit UC knows the speed of advance and the position of the sheet in the machine (it operates the main motor M50 via a control line L50 and checks this speed via an input line LE50 connected to a speed sensor) and, as a function of parameterization means MP entered in this unit UC so as to memorize the type of processing (cutout, folds) which has to be applied in such or such a region of the sheet, the latter can operate the motor M52 such that it positions the tools of the unit U1 in the correct place, at the correct moment and at the correct speed.

In the case in question, the position of the tools on the support shaft 52 is adjustable, as indicated in WO 02/02305.

For its part, the second support shaft 54 is rotationally driven by a motor M54, which is operated by the control unit UC via a control line L54.

In the case in question, the motors M52 and M54 can be operated in a master-slave relationship.

It is in fact on the basis of the operation of the motor M52, and by additionally knowing the position of the working strip(s) 57, that the motor M54 is operated by the control unit UC such that the or a working strip is situated opposite a tool 53 or 53' at the moment when this tool cooperates with the sheet, and is propelled with the correct speed relative to that of the tool 53.

Preferably, the tangential component V54 of this speed, like the tangential component V52 of that of the tool 53 or 53', is equal to the speed V of the sheet.

The control unit UC knows the speed of advance of the sheet and controls the speed of the motor M52 accordingly via the line L52. The control unit likewise knows the position of the working strip(s) 57 of the counter-tooling 56 (for example by a marking of the angular position of the counter-tooling 56 and/or of the shaft 52 and by a memorization of the position of the working strip(s) relative to a reference mark on the surface of the counter-tooling) and, as a function of the command which it gives to the motor M52, it likewise operates the motor M54. The control unit UC knows the speed of rotation of the shafts 52 and 54 via speed sensors, which are linked to these shafts and which are connected to this unit by input and speed-measuring lines LE52 and LE54, for the shafts 52 and 54 respectively. As a function of the data transmitted to it by these lines, the unit UC can operate the motors M52 and M54.

Similarly, for the processing unit U2, the first support shaft 62 is rotationally driven by a motor M62, which is operated by the control unit UC via a control line L62 and the speed of which is transmitted to this unit via an input line LE62.

The support shaft 54' of the counter-tooling 56' is rotationally driven by a motor M54', itself operated by the unit UC via a control line L54'. This unit knows the speed of this shaft via a speed-measurement-input line LE54' connected to a sensor.

As previously indicated, the tangential speed V52 of the tool 53 or 53' is equal to the drive speed V when this tool cooperates with a sheet for the processing of the latter. The motor M52 can be operated according to successive phases, comprising a standby stage, during which the tool is removed from the path of the sheets, and a processing phase, during which the tool cooperates with these sheets and during which the speed V52 is equal to the speed V. Between the standby phase and the processing phase, the motor M52 accelerates very rapidly, whereas it decelerates very rapidly after the processing phase.

In general terms, the first support shaft 52 or 62 of the unit U1 or U2 can be driven according to a sequence comprising a positioning phase, in the course of which it is driven so as to place the tooling which it bears in a position to process a defined region of the sheet, and a processing phase, during which the tooling is in contact with this defined region, is propelled with a tangential speed equal to the drive speed V and cooperates with its counter-tooling 56 or 56'. When the latter, like the counter-tooling 56, has working strips 57, a working strip 57 is situated opposite the tooling during the processing phase and is propelled with a tangential speed V54 equal to the speed V.

The shaft 52 can be a multi-tooled support shaft, capable of bearing at least two angularly spaced tools. This is what is seen in FIG. 1, in which two diametrically opposed tools 53, 53' are disposed on the shaft 52. The angular spacing of these two tools can be adjusted by adjusting means M, which are described in detail in WO 02/02305.

In this case, the control unit UC can operate the rotational drive of the shaft 52 according to a cycle comprising a processing phase performed by the first tool 53, in which this tool is in contact with a defined first region of a sheet situated in the processing zone T of the machine and is propelled with a tangential speed V52 equal to the speed V, a positioning phase, in the course of which the support shaft 52 is driven so as to place the second tool 53' in a position to process a defined second region of the sheet, and a processing phase performed by this second tool 53', in which the latter is in contact with the second region of the sheet and is propelled with a tangential speed V52 equal to the speed V. The positioning phase can comprise a standby phase or a very rapid rotation phase, according to the angular spacing between the tools 53 and 53' and the spacing between the regions of the sheet which have to be successively processed by these tools.

For its part, the second support shaft 54 can be operated so as to place a working strip 57 in a standby situation and to propel this strip with a tangential speed equal to the speed V when said strip is situated opposite the tool 53 which cooperates with it to process the sheet in the aforesaid first region. If the shaft 52 has the drive sequence described above, the shaft 54 can experience a new positioning phase in which another working strip, or the same one, is placed in a standby situation, so as then to be propelled with a tangential speed V54 equal to the speed V in such a way as to cooperate with the tool 53' in order to process the defined second region of the sheet.

As regards the second processing unit U2, in the represented example the first support shaft 62 bears a cylindrical surface S62, which bears a tool 63 capable of forming cutouts of the type of the cutouts 28 of the side flank represented in FIG. 2.

The shaft 62 is borne on a moving spindle 110, which is supported by a spacing shaft 106 by way of an eccentric 108. With the aid of a spacing motor M108, this eccentric can be rotationally driven so as to raise or lower the shaft 62 to which it is connected by a system of connecting rods 112 articulated on levers 114. The working of this system is described in detail in WO 02/02305.

Figure 3:
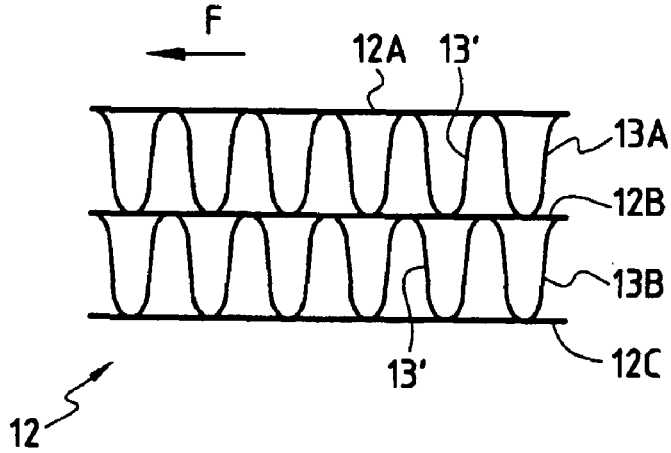
FIG. 3 shows, in section through its thickness, the structure of a sheet in which such a side flank can be produced.

As can be seen in FIG. 3, the sheet 12 has, for example, a multilayered structure with corrugated intermediate layers. It thus comprises an outer layer 12A, an intermediate layer 12B and another outer layer 12C, bracing layers 13A, 13B, made of corrugated material, being disposed between the layers 12A and 12B, on the one hand, and between the layers 12B and 12C, on the other hand. FIG. 3 indicates the drive direction F of the sheet in the machine, relative to which flutes 13' formed by the corrugated boards 13A and 13B are disposed transversely, as are the folds 24 and cutouts 22 and 28 in the side flank of FIG. 2.

For the processing of the sheet by the unit U1 or U2, the counter-tooling cooperates with the layer 12C, whereas the tool cooperates with the layer 12A. In the course of its displacement, it has a tendency to crush the flutes 13' and to bring the layer 12A closer to the layer 12C. When the layer 12C is neither able to experience a displacement of the same nature, if not of the same degree, the result is the creation of an unsightly fold on this layer 12C.

Figure 5:
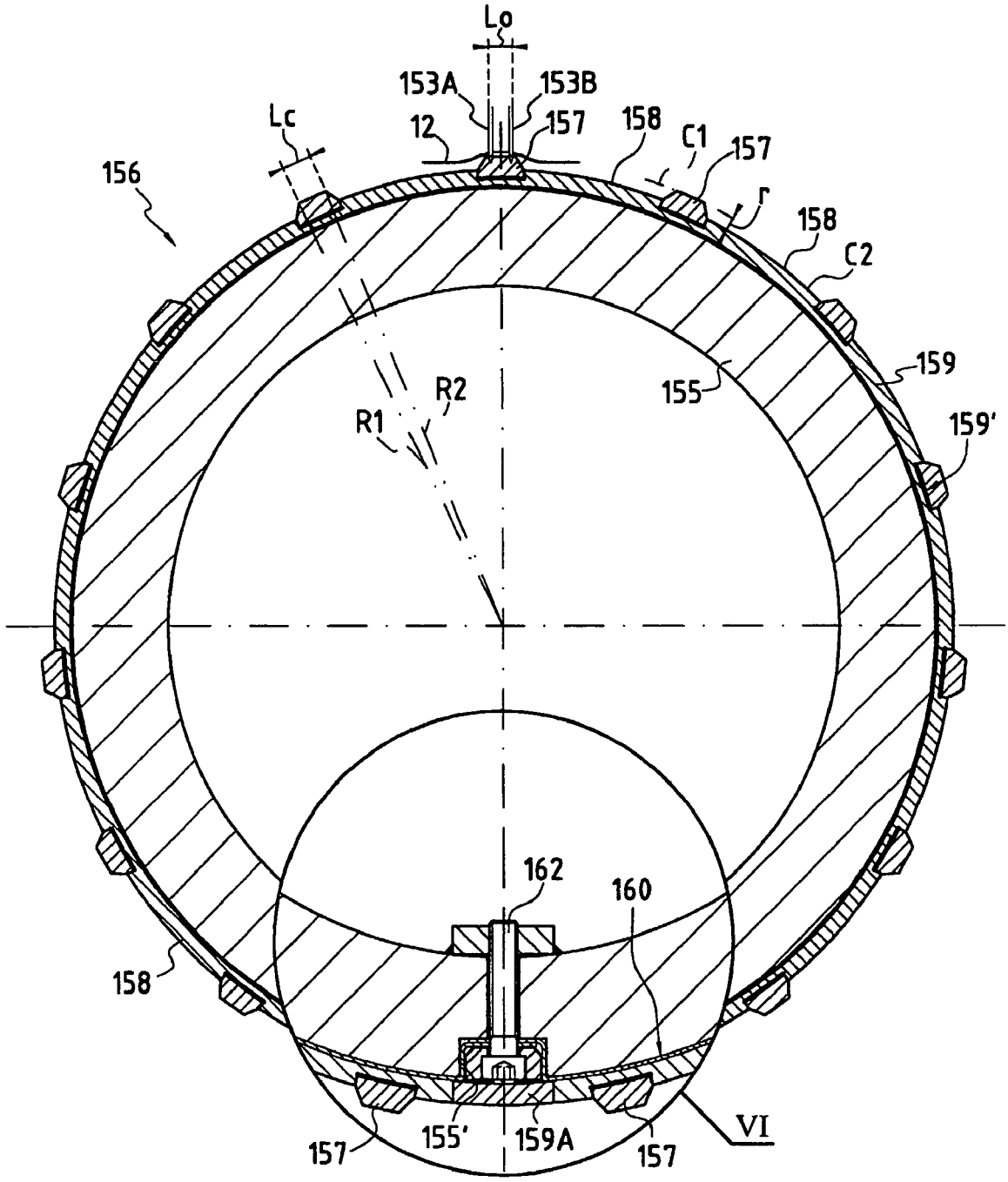
FIGS. 5 to 8 show the configuration of a counter-tooling, in sections transverse to the axis of its support shaft.

FIG. 5 shows a first embodiment for the realization of the counter-tooling of the machine of the invention. This comprises a hollow supporting cylinder 155, which can cooperate by its inner periphery with the second support shaft 54 in a manner which is known per se and is not represented, in order to rotationally drive the counter-tooling. The surface of this hollow cylinder 155 bears a lining, which cooperates with the tooling in order to process the sheet, by cutting or by the formation of folds.

In the case in question, the surface of the counter-tooling has a plurality of processing strips 157 which are regularly spaced in the angular respect. It can be seen that the working strips 157 project radially by a distance r relative to those portions 158 of the surface of the counter-tooling between which they are disposed. In fact, the surfaces of the working strips 157 are centered on a first circle C1, whereas the surfaces 158 are centered on a second circle C2, the radius of the circle C1 being greater by the distance r to that of the circle C2.

FIG. 5 illustrates the positions of the blades 153A and 153B of a cutting tool which cooperates with one of the working strips 157 to form a cutout in the sheet 12 (the latter being merely sketched).

It can be seen that the blades 153A and 153B penetrate slightly into the strip 157, which is formed, for example, of polyurethane. The strips 157 have, for example, the shape of prisms, the length of which is parallel to the axis of the hollow cylinder 155 and the base of which is substantially trapezoidal, as shown by the drawings. In the course of its processing by the tooling, the sheet rests on the upper face of a strip 157. It is deformed by the application of the tool against its surface, and, as can be seen in FIG. 5, the fact that the strips 157 project relative to the portions 158 of the surface of the tooling allows this deformation of the sheet to take place for those regions thereof which are adjacent to the cutting zone, without this sheet being pressed against the surface of the counter-tooling. The result is that permanent folds are prevented from being formed.

Preferably, the width of the or of each working strip is greater than the width of the tooling, though being approximate to this width. It is thus that the width Lc of a strip 57, measured between two radii R1 and R2 of the hollow cylinder 156, according to the upper face of this strip, is slightly greater than the width Lo of the tooling. This width Lo is measured between the outer faces of the blades 153A and 153B, between two radii of the cylinder 155.

Advantageously, the width Lc lies within the range 1.05 to 2 times the width Lo, preferably between 1.05 and 1.8 times this width Lo.

In the represented example, the counter-tooling 156 comprises a sheet metal plate 160, which is rolled onto the surface of the hollow cylinder 155 and is fixed thereon. For example, the two ends 160A and 160B of the sheet metal plate meet in a recess 155' in the surface of the cylinder 155, in which they are fixed by means of screws 162.

A lining 159, for example of polyurethane, is fixed on the surface of the sheet metal plate, except in the region of its ends. It is the outer surface of this lining which forms the aforesaid portions 158, appearing in the form of a withdrawn strip. The surface of the lining 159 likewise has receptacles 159' which are sunken relative to the surface 158 and in which the working strips 157 can be disposed. These strips are fixed in the receptacles, for example, by means of double-sided adhesive tapes. This allows a strip 157, when worn, to be rapidly removed from its receptacle for the placement there of a new strip.

In the region of the ends of the sheet metal plate 160, a detachable lining strip 159A can be fixed, for example by gluing or by means of a double-sided adhesive tape. The screws 162 can thus be accessed for fixing of the sheet metal plate and then coverage of these screws with the strip 159A.

Figure 6:
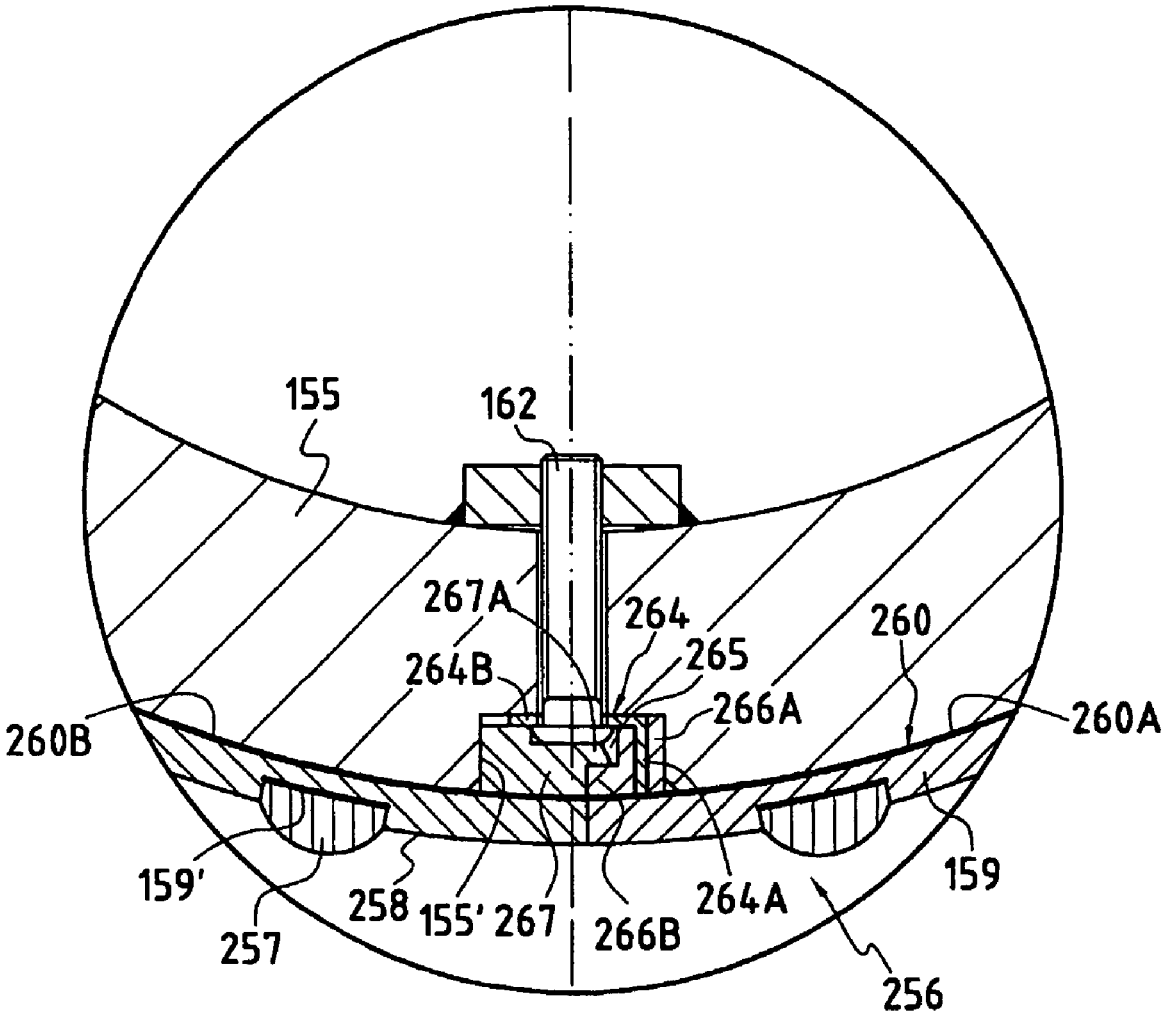

In FIG. 6, which shows an embodiment of FIG. 5 according to the enlarged portion VI, the working strips 257 of the counter-tooling 256 are fixed in the same way as the strips 157. They differ from the latter by the fact that they have a rounded outer surface.

This shape lends a homogeneous curvature to the bottom face of the sheet as it is processed. The prismatic shape of the sheets 157 can slightly mark the bottom face of the sheet along the edges of the prism during the processing of this sheet, which is not necessarily unaesthetic, since the fold or the cutout realized by the tool is perfectly positioned between these slight marks.

In FIG. 6, moreover, the method of fixing the plate 260 to the surface of the hollow cylinder 155 is slightly different from that in FIG. 5. Indeed, one of the ends 260A of the plate bears a right-angle bracket 264, which, on both sides of its bracing leg 264A, bears a pad made of a polyurethane-type material, respectively 266A and 266B. The right-angle bracket is disposed in the recess 155' in the hollow cylinder 155, its fixing leg 264B being fixed in this recess by means of a screw 162. The pad 266A rests against one of the sides of the recess 155', whereas the pad 266B forms a locking member beneath which a free space 265 (provided above the fixing leg 264B of the right-angle bracket) allows the insertion of a complementary locking member 267A fixedly connected to the other end 260B of the sheet metal plate, this locking member being formed by the fastening edge of a strip 267, for example made of polyurethane, fixedly connected to the sheet metal plate. This complementary locking member can likewise be made of a material akin to polyurethane. The plate is thus removable, but, when it is fixed on the hollow cylinder 155, its two free ends, extending along straight lines parallel to the axis of this cylinder, are end to end. As in the embodiment of FIG. 5, a lining 159 is fixed on the sheet metal plate and has receptacles 159' in which the working strips 257 can be fixed.

Figure 7:
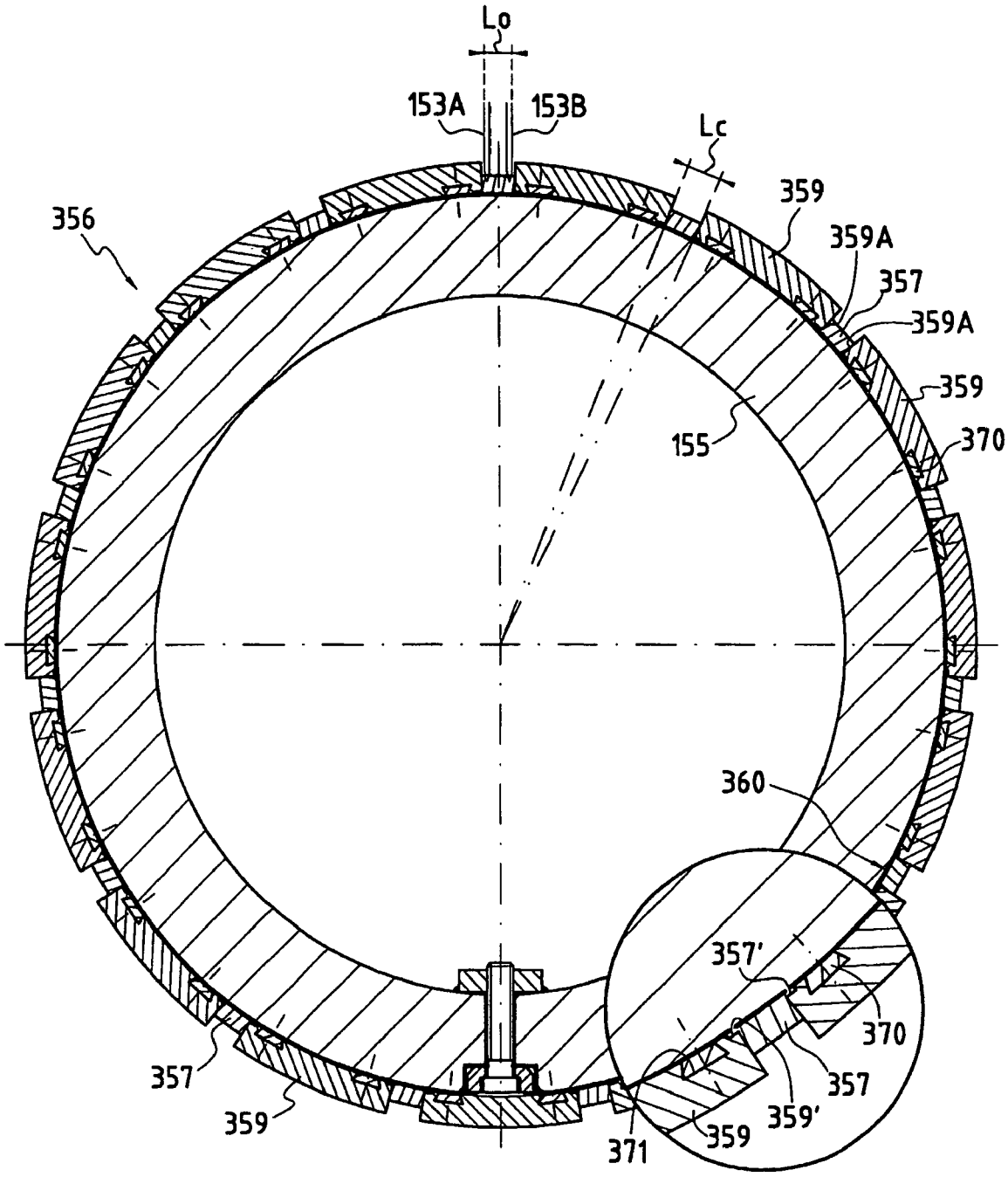

In FIG. 7, the surface of the counter-tooling is likewise borne by a support plate 360, for example fixed on the cylinder in the same way as the plate 160 of FIG. 5. Nevertheless, another fixing method, for example that of FIG. 6, could equally be used.

On this plate 360 are fixed at least two surface elements 359, which define between them, by their mutually opposite axial edges 359A provided with first holding surfaces, a receptacle for a working strip 357, the latter being capable of being inserted in this receptacle and having, on its axial edges, the second holding surfaces capable of cooperating with said first holding surfaces.

In the case in question, the counter-tooling comprises more than two working strips 357 and the number of surface elements 359 is greater than two.

In the represented example, the first holding surfaces formed on the axial edges 359A parallel to the axis of the second support shaft are produced by axial grooves 359' formed by an overhanging part of the holding elements 359, between said holding elements and the outer surface of the plate 360. For their part, the working strips have tabs 357', which are inserted in the channels or grooves 359'.

The working strips are inserted in the receptacles formed between two adjacent surface elements 359 by an axial displacement of these strips 357, the tabs 357' being placed in the channels 359'.

The working strips 357 are thus easily removable for replacement purposes.

In the embodiment of FIG. 7, the surface elements 359 are themselves fixed detachably on the support plate 360. For example, fixing strips 370 are fixed at regular intervals to the surface of the plate 360 and the surface elements 359 are held on these strips.

Thus, in the represented example, the inner faces of the elements 359 each have two axial grooves 371, the, for example, dovetailed profiles of which are matched to those of the strips 370. The surface elements 359 can thus be fixed on the plate by snap-locking, or by an axial displacement of these elements 359 allowing the strips to be threaded into the grooves 371. Axial stop means for determining the final position of the elements 359 can be linked to these strips.

It is thus possible to change the surface elements 359 which might be damaged.

According to the type of sheet having to be processed by the machine, the choice can be made to engage the tooling either with the working strips 357, or with the surface elements 359.

In FIG. 7 it can be seen that the working strips 357 of the counter-tooling 356 are set back relative to the adjacent surface elements. FIG. 7 shows the two blades 153A and 153B of a cutting tool, which cooperate with one of the working strips 357. In reality, the surfaces of the working strips appear as the bottoms of axial grooves in the surface of the counter-tooling. In order to make the cutout or fold, the tool penetrates into one of these grooves and pushes the sheet toward the bottom of this groove, that is to say toward a working strip. Consequently, the top (first in contact with the tool) and bottom (opposite the counter-tooling) layers are both deformed so as to penetrate into the aforesaid groove. The result is that the two layers of the sheet are slightly tensioned, even though the bottom layer, situated on the counter-tooling side, is less so than the top layer. The applicant has found that folds can be prevented from forming by this measure.

It is worth pointing out that the width Lc of the outer face of the strips 357, measured between two radii of the hollow cylinder 155, is slightly greater than the width Lo of the tool.

Figure 8:
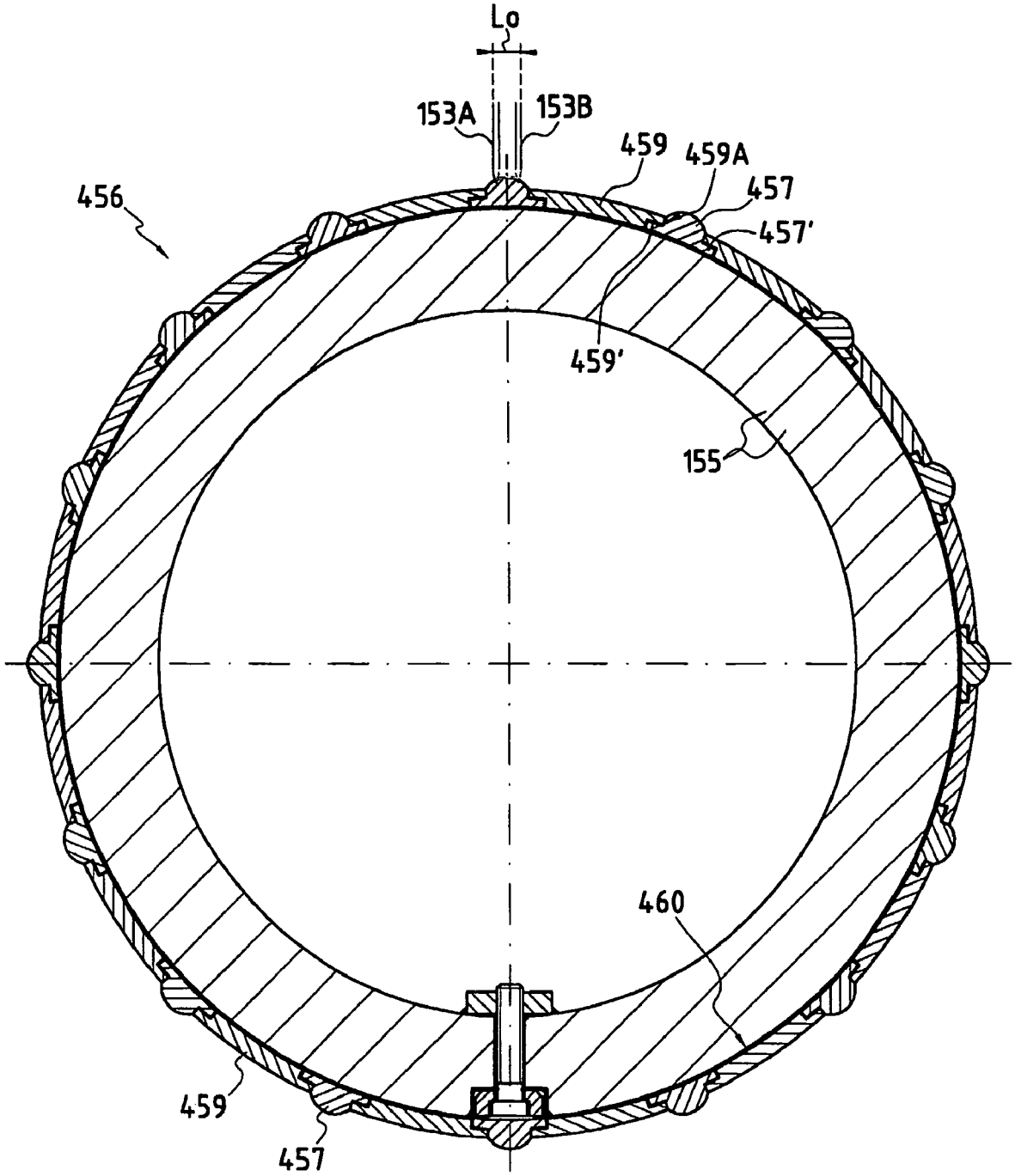

FIG. 8 returns to the embodiment of the working strips in the form of elements which project relative to the running surface of the counter-tooling 456, but proposes detachable fixing means for these strips which are akin to those in FIG. 7.

For example, the plate 460 is fixed on the surface of the hollow cylinder 155 in the same way as in FIG. 5.

A plurality of surface elements 459 is fixed on this plate so that two adjacent surface elements 459 define between them, by their mutually opposite axial edges, a receptacle for a working strip 457. The axial edges 459A of the surface elements 459 are provided with first holding surfaces formed by axial grooves 459', in which flanges 457' of the working strips 457 are engaged in order to hold said working strips in place.

The surface elements 459 can be fixed on the surface of the plate 460, for example by gluing or molding, or they can be detachably fixed on this plate, for example by means of double-sided adhesives.

The fixing screws for fixing the plate on the hollow cylinder 155 are arranged such that they are located in a zone provided between two adjacent surface elements 459, a zone which can be cleared when one of the working strips 457 is removed from its receptacle.

As in the previous figures, according to the type of sheet having to be processed, it can be the working strips 457 or surface elements 459 which are chosen to cooperate with the tooling.

The invention claimed is:

1. A machine for processing a sheet for production of packagings, the machine comprising:

a machine entrance, a machine exit and a processing zone positioned between the machine entrance and the machine exit, the processing zone including a sheet path;

a sheet drive operable to drive sheets in a drive direction and at a substantially constant drive speed through the processing zone;

a processing apparatus comprising a first tooling including blades, the first tooling supported by a first rotary support shaft and a counter-tooling supported by a second rotary support shaft, the first rotary support shaft and the second rotary support shaft extending transversely to the drive direction and positioned opposite each other and respectively on one and the opposite side of the sheet path, the processing apparatus being operable to produce at least one of a cutout and a fold disposed in the sheets transverse to the drive direction;

an operating apparatus for rotationally driving the first rotary support shaft and the second rotary support shaft so that at least at a moment when the first tooling and the counter-tooling cooperate with the sheet to make the at least one of the cutout and the fold, the first tooling is rotating at a processing speed having a tangential component equal to the drive speed, and the counter-tooling is situated opposite the first tooling;

the counter-tooling having a substantially cylindrical surface comprising at least one working strip positioned thereon, the at least one working strip extending in length parallel to a rotation axis of the second rotary support shaft and being radially offset relative to portions of the cylindrical surface adjacent to the at least one working strip, the at least one working strip being shaped and positioned to cooperate with the first tooling to form the at least one of the cutout and the fold;

the at least one working strip having a width in a circumferential direction greater than a width of the first tooling;

the at least one working strip comprising a flexible material to allow the blades of the first tooling to penetrate into said at least one working strip; and a first motor drive operable to drive the first rotary support shaft and a second motor drive operable to drive the second rotary support shaft such that the second motor drive is operated as a slave to the first motor drive, wherein the working strip includes a top surface radially offset at a first height relative to the portions of the cylindrical surface immediately adjacent the at least one working strip, and an auxiliary surface positioned immediately adjacent the top surface along the width in the circumferential direction of the working strip, the auxiliary surface being radially offset at a second height relative to the portions of the cylindrical surface immediately adjacent the at least one working strip, wherein the first height is greater than the second height.

2. The machine as claimed in claim 1, further comprising a plurality of working strips spaced angularly apart on the surface of the counter-tooling and projecting from the cylindrical surface of the counter-tooling.

3. The machine as claimed in claim 2, further comprising withdrawn strips positioned on the surface of the counter-tooling in a regular alternation along the circumferential direction with the plurality of working strips which project from the cylindrical surface.

4. The machine as claimed in claim 2, wherein the width of each working strip of the plurality of working strips lies within a range of 1.05 to 1.8 times the width of the first tooling.

5. The machine as claimed in claim 1, wherein the at least one working strip is mounted detachably on the counter-tooling.

6. The machine as claimed in claim 1, further comprising:

a detector operable for determining information relating to a position of the sheet in the processing zone;

a control unit operable, as a function of the determined information relating to the position of the sheet in the processing zone, to control the first motor drive of the first rotary support shaft and the second motor drive of the second rotary support shaft so that, during processing of the sheet, the first tooling is in contact with a predefined region of the sheet and the first tooling is propelled with a processing speed having a tangential component equal to the drive speed of the sheet, while the working strip is positioned and operable such that the working strip is in contact with the defined region of the sheet, on the other side of the sheet relative to the first tooling.

7. The machine as claimed in claim 6, wherein the control unit operates the first motor drive and the second motor drive so that, at least when the first tooling and the at least one working strip cooperate with the sheet for the processing of the sheet, the first tooling and the at least one working strip are each propelled at the processing speed.

8. The machine as claimed in claim 6, wherein the first rotary support shaft is a multi-tooled support shaft supporting at least a first tool and a second tool which are spaced angularly apart around the first rotary support shaft;

the control unit operates the first motor drive of the multi-tooled support shaft according to a cycle comprising a processing phase in which the first tool is in contact with a defined first region of the sheet then situated in the processing zone of the machine and the first tool is propelled with the processing speed, followed by a positioning phase in which the multi-tooled support shaft is driven to place the second tool in a position to process a defined second region of the sheet, and followed by a processing phase in which the second tool is in contact with the second region and the second tool is propelled with the processing speed.

9. The machine as claimed in claim 8, comprising a second working strip, wherein the control unit operates the second motor drive of the second rotary support shaft so that, in the course of the cycle, the first tool and the second tool of the first rotary support shaft cooperate with the at least one working strip and the second working strip.

10. The machine as claimed in claim 9, wherein the control unit operates a rotational drive of the first rotary support shaft and the second rotary support shaft, and is operable to control the rotational drive so that, during successive processing of a plurality of sheets, the tooling cooperates successively with a different working strip of the at least one working strip and the second working strip.

11. The machine as claimed in claim 1, wherein the at least one working strip has the width in the circumferential direction within a range of 1.05 to 2 times greater than the width of the first tooling.

12. The machine as claimed in claim 1, wherein the top surface of the working strip has a width in the circumferential direction greater than the width of the first tooling.

13. The machine as claimed in claim 1, wherein the height of the auxiliary surface decreases along a sloped line from the second height immediately adjacent the top surface in the circumferential direction.

14. The machine as claimed in claim 1, further comprising a second auxiliary surface immediately adjacent the top surface along the width in the circumferential direction, the second auxiliary surface positioned on an opposite side of the top surface from the auxiliary surface, the second auxiliary surface being radially offset by the second height relative to the portions of the cylindrical surface immediately adjacent the at least one working strip.

15. The machine as claimed in claim 14, wherein the auxiliary surface, the top surface and the second auxiliary surface together form a rounded outer surface relative to the portions of the cylindrical surface immediately adjacent to the at least one working strip.

16. The machine as claimed in claim 14, wherein the height of the second auxiliary surface decreases from the second height immediately adjacent to the top surface along the circumferential direction.

* * * * *

UNITED STATES PATENT AND TRADEMARK OFFICE

CERTIFICATE OF CORRECTION

PATENT NO. : 8,176,821 B2
APPLICATION NO. : 10/517037
DATED : May 15, 2012
INVENTOR(S) : Jean-Jacques Taillardat It is certified that error appears in the above-identified patent and that said Letters Patent is hereby corrected as shown below:

Title Page, Item (54) and Col. 1, lines 1-3, should read:

MACHINE FOR PROCESSING SHEETS WITH CUTOUTS OR FOLDS TRANSVERSE TO THEIR FORWARD MOVING DIRECTION

Signed and Sealed this
Twentieth Day of November, 2012

David J. Kappos

David J. Kappos
*Director of the United States Patent and Trademark Office*